US008312902B2

(12) United States Patent
Mengibar Rivas

(10) Patent No.: US 8,312,902 B2
(45) Date of Patent: Nov. 20, 2012

(54) FILLING HEAD WITH LOW REYNOLDS NUMBER

(75) Inventor: Antonio Mengibar Rivas, Barcelona (ES)

(73) Assignee: Antonio Mengibar, S.A., Rubi, Barcelona (ES)

( * ) Notice: Subject to any disclaimer, the term of this patent is extended or adjusted under 35 U.S.C. 154(b) by 993 days.

(21) Appl. No.: 12/161,616

(22) PCT Filed: Nov. 14, 2006

(86) PCT No.: PCT/ES2006/000622

§ 371 (c)(1),
(2), (4) Date: Jul. 21, 2008

(87) PCT Pub. No.: WO2007/082966

PCT Pub. Date: Jul. 26, 2007

(65) Prior Publication Data

US 2009/0301605 A1 Dec. 10, 2009

(30) Foreign Application Priority Data

Jan. 20, 2006 (ES) ..... 200600130

(51) Int. Cl.
*B67C 3/26* (2006.01)
*F47K 47/08* (2006.01)

(52) U.S. Cl. ..... 141/286; 141/192; 222/547; 222/559; 222/564; 222/566; 251/122; 251/63.5

(58) Field of Classification Search ..... 141/146, 141/192, 258, 260, 285, 286, 292, 293, 301, 141/302, 351; 222/544, 547, 559, 563, 564, 222/566, 571, 572; 251/122, 62.3
See application file for complete search history.

(56) References Cited

U.S. PATENT DOCUMENTS 3,317,184 A * 5/1967 Usry ..... 251/122
(Continued)

FOREIGN PATENT DOCUMENTS

EP 2208439 11/2000
(Continued)

OTHER PUBLICATIONS

International Search Report for International Application PCT/ES2006/000622 mailed Apr. 25, 2007.

*Primary Examiner* — Timothy L Maust
*Assistant Examiner* — Timothy Kelly
(74) *Attorney, Agent, or Firm* — Merchant & Gould P.C.

(57) ABSTRACT

The invention relates to a filling head with low Reynolds number, consisting of an inner body (2) and an outer body (3), in which one moves axially with respect to the other, there being a space (4) delimited between them that configures the dynamic characteristics that the flow will have, comprising a damping zone A with inlet (5) located on a different axis from that of the outlet (6), a pressure-loss zone B with seated valve (7), a zone C, with low Reynolds number, composed of n channels (10), with n fins (9) greater than 3 and LRHC less than 4, an ogival acceleration zone D and a nozzle (8) or closure zone E with a seal (13).

6 Claims, 2 Drawing Sheets

U.S. PATENT DOCUMENTS

| | | | | | |
|---|---|---|---|---|---|
| 5,085,354 | A | * | 2/1992 | Sogliani et al. | 222/504 |
| 5,228,604 | A | * | 7/1993 | Zanini et al. | 222/504 |
| 5,816,456 | A | * | 10/1998 | Graffin | 222/559 |
| 5,878,992 | A | * | 3/1999 | Edwards et al. | 251/122 |
| 6,375,050 | B1 | * | 4/2002 | Gruson | 222/504 |
| 7,156,267 | B2 | * | 1/2007 | Zanga | 222/504 |
| 8,109,416 | B2 | * | 2/2012 | Morand | 222/559 |
| 2009/0166386 | A1 | * | 7/2009 | Morand | 222/559 |

FOREIGN PATENT DOCUMENTS

| | | | |
|---|---|---|---|
| ES | 2 066 315 | | 3/1995 |
| ES | 2 128 869 | | 5/1999 |
| FR | 2 861 716 | | 5/2005 |
| WO | PCTWO/97/02206 | | 7/1996 |
| WO | PCTWO/01/40098 | A1 | 11/2000 |
| WO | WO 03/037779 | | 5/2003 |
| WO | WO 2005/042396 | | 5/2005 |

* cited by examiner

FILLING HEAD WITH LOW REYNOLDS NUMBER

BACKGROUND OF THE INVENTION

1. Object of the Invention

As expressed in the title of this specification, the present invention relates to a filling head with low Reynolds number providing the function for which it is intended with a series of advantages and features, apart from those inherent to its organization and constitution, which will be described in detail below and which involve an innovative alternative and/or improvement to what is already known in this field.

More specifically, the object of the invention consists of a head for fillers the studied design of which is an important progress in the filling of liquids, the behavior of the fluid improving considerably in relation to known systems, such that it allows increasing the filling speed taking the fluid to a low Reynolds number in order to progressively accelerate it towards the outlet, conserving the balance achieved between inertial forces and viscous shear forces.

2. Field of Application

The invention which is set forth is comprised in the field of machinery for filling liquids in their corresponding containers.

Its application therefore corresponds to the industry of conditioning and packaging liquid products from any industrial sector (such as food, pharmacy, cosmetics, cleaning, detergents, foaming agents, corrosive products, viscous products, fluids, hot, cold, lubricants, solvents, . . . ) with no limitation other than that of being products in liquid state.

BACKGROUND OF THE INVENTION

The main element of any type of filler, either a linear or rotary filler, is currently the filling head. The latter is the main element responsible for ensuring a correct filling. Great effort is therefore concentrated on its improvement and innovation.

An essential factor in the packaging process is the time in which the container is filled, because said factor will delimit the number of heads necessary for obtaining the desired production and as a result, the size of the filler.

The main drawbacks such as splashing, foam, overflowing, etc. arise at high jet outlet velocities.

There are several ways to prevent these problems:

Sending the jet against the inner wall of the containers.

Submerging the nozzle below the product level. The nozzle performs an upward movement from the base of the container until it comes out of it, being submerged during the filling.

Achieving a coherent and uniform flow filling the container with or without introducing the nozzle therein.

The latter route is chosen in the invention set forth herein.

The applicant knows of the existence of several patents relating to devices with a similar nature and the object of which is similar to the one at hand, such as PCT WO 01/40098 A1 dated Jun. 7, 2001; PCT WO 97/02206 dated Jan. 23, 1997; and PCT publication number 2 208 439, a European patent translation dated Jun. 16, 2004, which, however, are based on a different geometry and hydraulics.

It must therefore be mentioned that the applicant does not know of the existence of a filling head with low Reynolds number having structural and constitutive features similar to those proposed in the present invention, the object of which is to overcome the aforementioned drawbacks of currently known systems for the same purpose.

DESCRIPTION OF THE INVENTION

As has been indicated in the previous section, the invention that is set forth is a new development in the filling of liquids.

The two great drawbacks arising when the filling is carried out a high jet velocity are, as has been mentioned, foam formation and splashing.

Foam formation is due to the mixture of air with the liquid where, as a result of the surface tension of the latter, bubbles are formed which end up forming the foam.

The higher the surface tension of the liquid to be filled, more foam can it generate and more persistent will such foam be. Therefore, to achieve a filling without foam a minimum interaction between the liquid and air must be achieved.

As regards splashing, it is mainly due to the overaccelerations experienced by the fluid at the times of opening and closing the nozzle.

These overaccelerations are typical of any filling nozzle, valve or variable mechanism for obstructing the passage of a fluid.

When a valve is open, there is a certain product outlet velocity.

This velocity is given by the pressure existing upstream in the network and the pressure loss experienced by the product as it moves forward.

This pressure loss, which occurs throughout the conduits and in the valve itself, is proportional to the square of the velocity.

If the valve is slightly closed, the outlet area is narrowed (because it is between the open and closed position), which involves an obstruction in the outlet increasing the general pressure loss of the system.

This makes the outlet flow rate decrease, therefore the fluid velocity in the conduits and also the pressure loss therein decrease, the pressure right before the obstruction caused by the valve therefore increasing.

Therefore, on one hand, the outlet section has narrowed, and on the other hand, the fluid pressure right before the obstruction represented by the valve has increased.

Both factors contribute to increasing the fluid velocity at the times of opening and closing a valve.

The filling head that is set forth improves the behavior of the fluid in relation to current conventional systems in the two aforementioned problems, allowing a higher filling velocity.

The foam problem is minimized by reducing the inertial forces which the fluid is subjected to, i.e., reducing its Reynolds number. A coherent and uniform flow is thus achieved which prevents air from interacting with it.

The physical concept of the Reynolds number for achieving a non-turbulent flow was developed during the $19^{th}$ century by Osborne Reynolds, and since then it has become a cornerstone in the development of fluid engineering.

The Reynolds number is a dimensionless number indicating the ratio between the inertial forces which a fluid is subjected to and the viscous shear forces.

The splashing problem due to fluid overaccelerations is solved by creating between the damping chamber (zone A) and the zone with Low Reynolds number (zone C), a pressure-loss zone (zone B) controlled by means of a non-tight seated valve, designed to obtain a (previously determined) velocity curve during the closing and the opening of the filling nozzle.

More specifically, the filling head is composed of an inner body and another outer body, there being a single degree of freedom of movement between them, such that they can only move in an axial direction with respect to one another.

The empty space existing between them forms the fluid passage zone.

Said space is subdivided into five zones that are independent but strongly interrelated to one another:

Zone A or damping chamber

It is a chamber before the zone with low Reynolds number, where the upstream fluid (i.e., before it enters the filling head) is kinematically and dynamically separated from the downstream fluid.

Zone B or pressure-loss zone

Its objective is to control the pressure loss during the opening and the closing of the valve. It can be likened to a non-tight seated valve forming the transition between the damping zone and the zone with Low Reynolds number.

Zone C or zone with low Reynolds number

It is a tubular space subdivided into channels where a coherent and uniform flow is achieved upon decreasing the inertial forces which the fluid is subjected to, thus reducing its Reynolds number.

Zone D or acceleration zone

Its objective is to take the fluid from the zone with low Reynolds number to the closure zone (nozzle).

To prevent draining problems, due to the action of gravity on the fluid.

The configuration of the nozzle is such that the velocity in zone C is less than the velocity in zone D.

The change of velocity between the beginning of zone C and the end thereof occurs linearly, thus achieving a constant acceleration and emulating the movement imparted by gravity on the fluid by nature.

Unwanted product accelerations as well as a fluid conduction without fluctuations which can return to turbulent flow are thus also prevented.

Zone E or closure zone "nozzle"

It corresponds to the end of the filling head. Its objective is to finish taking the product to the outlet when the filling head is in an open position, and to ensure a tight closure when it in a closed position.

The novel filling head with low Reynolds number therefore represents an innovative structure with structural and constitutive features that were unknown up until now for such purpose, which reasons, in addition to its practical usefulness, provide it with sufficient grounds for obtaining the exclusive privilege which is requested.

DESCRIPTION OF THE DRAWINGS

To complement the description which is being made and for the purpose of aiding to better understand the features of the invention, a set of drawings is attached to this specification as an integral part thereof, in which the following has been shown in an illustrative and non-limiting manner.

PREFERRED EMBODIMENT OF THE INVENTION

In view of the mentioned figures and according to the adopted numbering, a preferred embodiment of the filling head with low Reynolds number comprising the parts indicated and described below can be observed in such figures.

Figure 2:
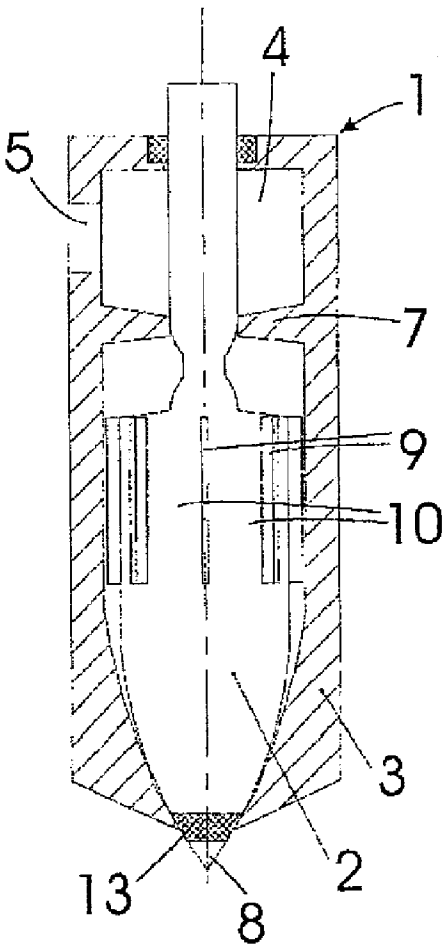
FIG. 2 shows a view of the head shown partially sectioned like in FIG. 1, but in a closed position.
Figure 1:
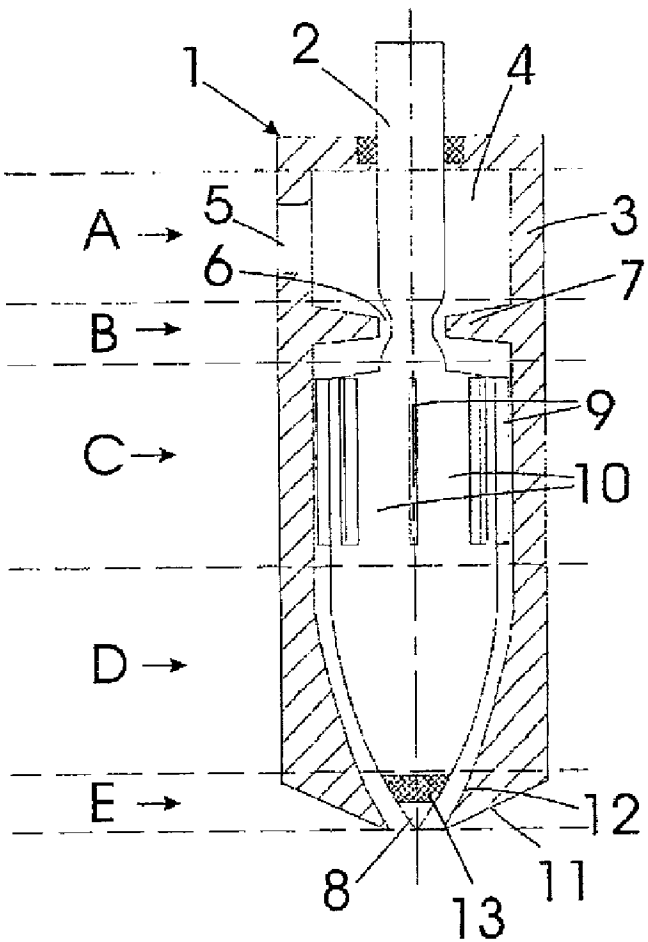
FIG. 1 shows an elevational view of the filling head with low Reynolds number of the invention in an open position, which has been shown partially sectioned according to a longitudinal cut such that the elements forming it as well as its configuration and arrangements can be observed.

Thus, as can be seen in FIGS. 1 and 2, the filling head (1) is formed by an inner body (2) and an outer body (3).

One moves axially with respect to the other.

The space (4) delimited between them configures the dynamic characteristics that the flow will have.

Zone A or damping chamber

The objective of this chamber is to kinematically and dynamically separate the upstream fluid of this zone A from the downstream fluid.

It is therefore a damping chamber, where the directions of the velocity vectors are broken.

The damping function due to the quick widening of the chamber prevents possible vibrations from increasing the inertial forces on the downstream fluid in an unwanted manner.

The volume of this chamber is equal to or greater than 50% of the volume enclosed between both bodies (2) and (3).

It can be approximated to a cylinder (with a frustoconical or concave base) the diameter of which is close to that of zone C or zone with low Reynolds number.

It is also characterized by having a product inlet (5) located on a different axis from the axis of the outlet (6), and by having an outlet in the form of a seated valve (7) (described in zone B).

Zone B or pressure-loss zone

The objective of this zone B is to create a controlled pressure loss in order to not cause overaccelerations at the times of opening and closing the nozzle (8).

This is achieved by means of a "seated valve" type closure (7), which has been designed based on the desired fluid velocity at the outlet of the nozzle (8) during the processes for opening and closing such nozzle.

Figure 3:
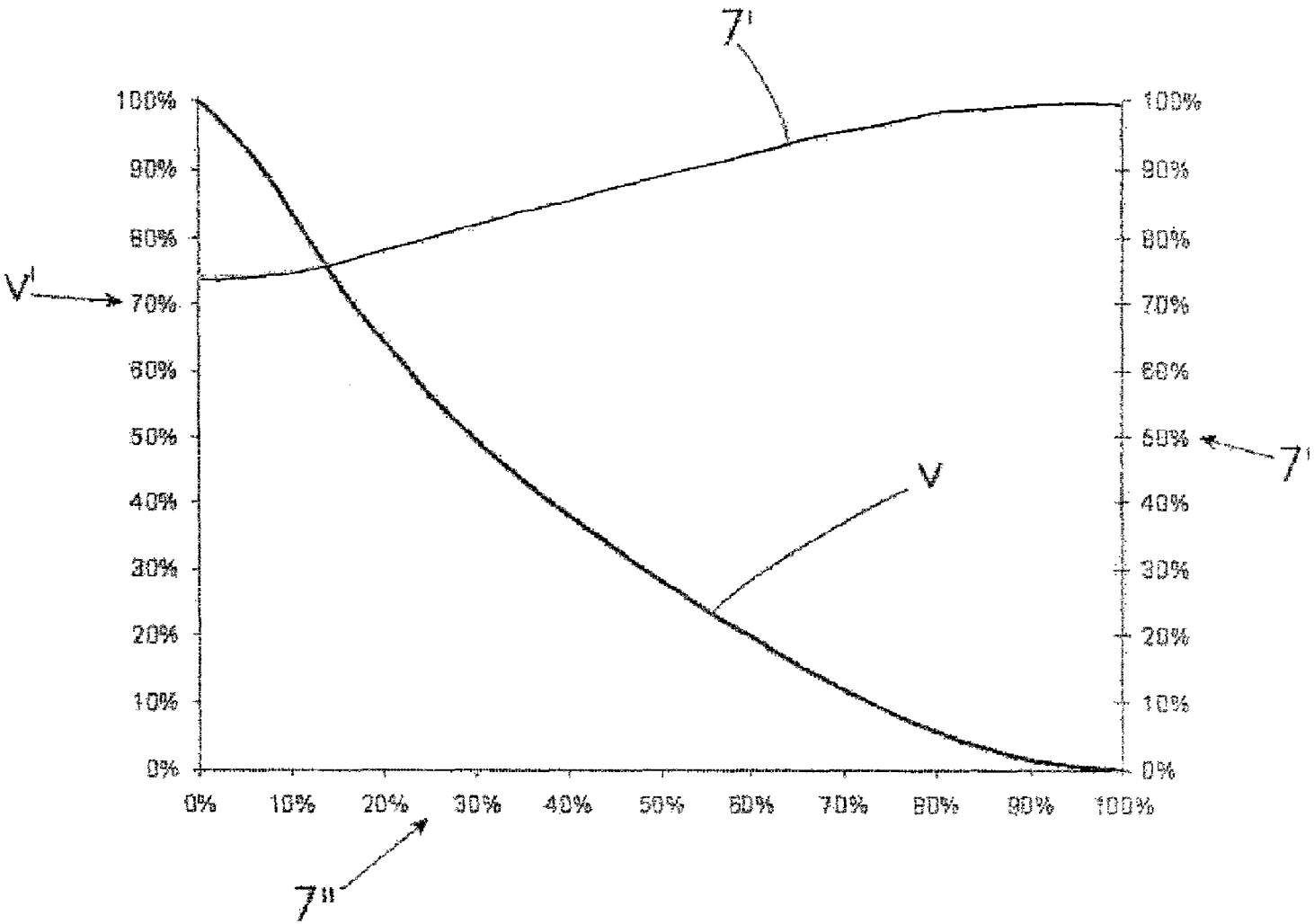
FIG. 3 shows a graph showing the relationship between the fluid velocity curve and the inner diameter of the seated valve in the design of zone B or pressure-loss zone.

As can be observed in the graph of FIG. 3, in which the velocity curve has been designated as (v), the % values of velocity as (v'), the inner diameter of the seated valve as (7), the percentage of diameter of the seated valve as (7') and the percentage of closure of the seated valve as (7"), the velocity curve according to the stroke complies with the following requirements:

1. As the valve (7) closes, the fluid velocity (v) decreases.
2. The slope of the velocity curve (v) decreases as the valve (7) closes.

In other words, the velocity decreases more quickly at the beginning and more slowly at the end.

For example, when the valve (7) has closed 25% of its stroke, the outlet velocity (v) has been reduced by 50% (see FIG. 3).

3. When the seated valve (7) has closed, the value of the velocity (v) must be negligible.
4. When the valve (7) is open, the value of the velocity (v) must be maximum, i.e., the pressure loss created by the seated valve (7) is negligible.

According to these conditions of desired velocity, the inner diameter of the nozzle (8) will follow a curve of the following type, $$D_{int_B} = \sqrt{k_1 - \frac{\left(\frac{1}{C_c} - 1\right)k_2}{(k_3 v_{ZoneB}^{-2} + k_4)^{1/2}}}$$

$D_{int_B}$: Diameter of the inner body in zone B $k_i$: Constants $C_c$: Weisbach contraction coefficient (in this case $0.6<C_c<0.7$)

$V_{Zone\ B}$: Fluid velocity in zone B where the diameter of the body in zone B can vary depending on the viscosity of the product to be packaged and the required flow rate.

Zone C or zone with low Reynolds number

This zone is a tubular space the inner diameter of which is the typical one of the inner body (2) and the outer diameter of which corresponds to the inside of the outer body (3).

Said tubular space is subdivided into n equal parts by means of longitudinal walls which will be called fins (9), forming n channels (10) through which the fluid will pass.

There are therefore n channels (10) through which the fluid circulates.

This geometry forces the fluid to circulate with low velocity kinematic characteristics.

"Contour conditions" in the two directions perpendicular to the fluid movement achieving a coherent and uniform flow are added to the above.

The number of channels (10) depends on the diameter of inner body (2).

The length of this zone is the necessary length to achieve a coherent flow at the outlet.

The Reynolds number is defined as:

$$Re = \frac{\rho v D}{\mu}$$

ρ: density [kg/m$^3$]

v: characteristic velocity [m/s]

μ: dynamic viscosity [Pa·s]

D: characteristic diameter [m]

The Reynolds number indicates which is the ratio between the inertial forces (ρvD) and the viscous shear forces (μ).

But its analysis is still more detailed, because it indicates that this ratio between inertial forces and viscous shear forces is a function of physical parameters (ρ, μ), kinematic parameters (v) and geometric parameters (D).

Taking into account all these considerations, all the physical and kinematic parameters can be grouped into a variable "f", such that "f" is a function of the physical and kinematic parameters expressed independently of the geometry of the problem in question.

The Reynolds number can thus be expressed as, $$Re = f \cdot LRHC$$

Re: Reynolds number [dimensionless]

f: Function of the physical and kinematic parameters [mm$^{-1}$]

LRHC: Coefficient which is a function of the geometry of the head [mm]

LRHC (Low Reynolds Head Coefficient) is a characteristic coefficient of the geometry of the filling head (1).

It is independent of physical and kinematic parameters.

LRHC is a new concept, developed to design, define and compare the geometry of the filling heads (1) set forth in this specification.

The value of LRHC is:

$$LRHC = \frac{1}{2}\frac{D_{ext_C}^2 - D_{int_C}^2}{\left(1+\frac{n}{\pi}\right)D_{ext_C} + \left(1-\frac{n}{\pi}\right)D_{int_C}} \text{[mm]}$$

$D_{int_C}$: Diameter of the inner body in zone C. [mm]

$D_{ext_C}$=Inner diameter of the outer body in zone C. [mm]

n: Number of fins (9) [dimensionless]

Zone C or zone with low Reynolds number has an inner diameter of the outer body, a diameter of the inner body and a number of fins such that:

$$LRHC<4$$

Zone D or acceleration zone

The function of this zone is to take the fluid from zone C to the outlet.

To prevent draining problems due to the action of gravity, which would cause the entrance of air inside the zone and subsequently turbulences and foam when air and fluid are mixed, the geometry of this zone D is such that the velocity at the beginning is less than at the end thereof.

For this purpose, the outlet diameter depends on the geometry of zone C, such that:

$$D_{out} \leq 0.7\sqrt{D_{ext_C} - D_{int_C}^2}$$

$D_{out}$: Inner diameter of the outer body (3) at the outlet (nozzle (8)) [mm]

$D_{int_C}$: Diameter of the inner body (2) in zone C. [mm]

$D_{ext_C}$: Inner diameter of the outer body (3) in zone C. [mm]

The inner body (2) in this zone is ogival-shaped, which ensures a sinusoidal progression of the velocity component perpendicular to the main direction, which tends to join the annular flow into a single cylindrical flow.

The length of zone C is that achieving that the flow subjected to a constant acceleration linearly acquires the velocity at the outlet of zone D. This length L corresponds to:

$$L \approx \frac{5}{8}\frac{1}{a}$$

where,

L: length of zone D [m]

a: acceleration (between 50 and 90% of the acceleration of gravity) [m/s$^2$].

The value of a will vary within this range according to the slenderness of the ogive which is the inner body (2).

This slenderness will determine the mean angle formed by the ogive and a horizontal surface, and therefore the effective gravity component on the fluid.

In addition, a correction factor is introduced to take into account the forces caused by viscosity.

L is therefore the length for the flow to acquire its velocity in zone D due to the action of the weakened gravitational field.

The design of the shape of the outer nozzle is such that it achieves a constant fluid acceleration along zone D.

In other words, the velocity increases linearly along this zone.

This involves a potential decrease of the annular passage section in the following way, $$S(x) = \frac{1}{k_1 + k_2 x}$$

where,

S: Annular passage section along zone D [mm$^2$]

$k_1$: Constant [mm$^{-2}$]

$k_2$: Constant [mm$^{-1}$]

x: Length covered of zone D [mm$^{-1}$]

Both the inner body (2) and the outer body (3) always have in zone D a slope that increases as the outlet (filling nozzle (8)) is approached.

There are no turning points or discontinuities in the slopes of any of the two curves.

Zone E or closure zone (nozzle)

The closure of the filling head (1) occurs when the inner body (2) rests on the outer body (3), as observed in FIG. 2.

The contact zone between both occurs at the lower part (nozzle (8)).

The outer body (3) ends abruptly with a slope (11), at the outer part, slightly more horizontal than the slope (12) in this same zone on the inner side.

The inner body (2) in turn has a closing seal (13) ensuring the tightness.

In the same way as in zone D, in the nozzle (8) there are no turning points or discontinuities in the slopes of any of the two curves characterizing the geometry of the inner body (2) and outer body (3).

Having sufficiently described the nature of the present invention, as well as the way of putting it into practice, it is stated that, within its essence, it can be put into practice in other embodiments which differ in detail from the one indicated by way of example, and which are also covered by the protection claimed provided that its essential principle is not altered, changed or modified.

The invention claimed is:

1. A filling head with low Reynolds number, of the type intended to fill liquids or fluids in corresponding containers by means of both a linear and rotary filler, comprising an inner body and an outer body, in which one moves axially with respect to the other, there being a space delimited between them forming a fluid passage zone subdivided into five zones:

a damping zone A having an inlet, a pressure-loss zone B having a seated valve containing an outlet through which extends the inner body, a zone C with low Reynolds number, an acceleration zone D, and a nozzle or closure zone E, wherein:

the damping zone A has a volume in the order of 50% or greater than the volume enclosed between the outer body and the inner body;

the pressure-loss zone B is designed to obtain a velocity curve during the closing and the opening of the nozzle, wherein the diameter of the inner body varies along the pressure-loss zone B, so that the slope of the velocity curve decreases continuously as the seated valve closes, more quickly at the beginning and more slowly at the end;

the inner body along the acceleration zone D and the closure zone E has an ogive shape; and the acceleration zone D is designed to achieve a constant acceleration of the fluid along zone D, wherein the annular section of the fluid passage varies along zone D so that the velocity in zone D increases linearly; and the zone C with low Reynolds number comprises a plurality of fins defining a same number n of channels between the fins for the passage of liquid or fluid, wherein the geometry of the filling head is defined by a characteristic coefficient that follows the expression:

$$LRHC = \frac{1}{2}\frac{D_{ext_C}^2 - D_{int_C}^2}{\left(1+\frac{n}{\pi}\right)D_{ext_C} + \left(1-\frac{n}{\pi}\right)D_{int_C}}$$

wherein

LRHC is the characteristic coefficient of the geometry of the filling head, being LRHC less than 4;

$D_{int_C}$ is the diameter of the inner body in the zone C with low Reynolds number;

$D_{ext_C}$ is the inner diameter of the outer body in zone C with low Reynolds number;

n is the number of fins and channels, greater than 3;

wherein zone C has a length necessary to be able to break the fluid turbulence.

2. The filling head with low Reynolds number according to claim 1, wherein the maximum diameter of the inner body in the zone B is smaller than the inner diameter of the outer body in said zone B.

3. The filling head with low Reynolds number according to claim 1, wherein the variation of the diameter of the inner body in the pressure-loss zone B follows the expression:

$$D_{int_B} = \sqrt{k_1 - \frac{\left(\frac{1}{C_c} - 1\right)k_2}{(k_3 v_{out}^{-2} + k_4)^{1/2}}}$$

wherein $D_{int_B}$ is the diameter of the inner body in the pressure-loss zone B;

$v_{out}$ is the product velocity upon coming out of the nozzle, a value depending on the position of the inner body with respect to the outer body;

$k_i$ are constants;

$C_c$ is the coefficient of contraction;

wherein $v_{out}$ reaches a maximum value when the seated valve is open;

$y_{out}$ reaches a 50% of the maximum value when the seated valve has closed approximately the 25% of its stroke; and $v_{out}$ is negligible when the seated valve is close.

4. The filling head with low Reynolds number according to claim 1, wherein the variation of the section of the fluid passage along acceleration zone D follows the expression:

$$S(x) = \frac{1}{k_1 + k_2 x}$$

wherein

LRHC is the characteristic coefficient of the geometry of the filling head, being LRHC less than 4;

$D_{int_C}$ is the diameter of the inner body in the zone C with low Reynolds number;

$D_{ext_C}$ is the inner diameter of the outer body in zone C with low Reynolds number;

n is the number of fins and channels, greater than 3;

wherein the length of the zone C is the necessary length in order to be able to break the fluid turbulences.

5. The filling head with low Reynolds number according to claim 1, wherein the acceleration zone D has a length that follows the expression:

$$L \approx \frac{5}{8}\frac{1}{a}$$

wherein

L is the length of the acceleration zone D;

a is the constant acceleration of the fluid along zone D, comprised between 50%-90% of the value of the acceleration of gravity.

6. The filling head with low Reynolds number according to claim 1, wherein the closure zone E incorporates a seal of the same or different material from the actual body at the lower end of the inner body; and wherein the end part of the filling nozzle in the outer body has an abrupt end with a slightly more open angle than that of the inner body in the closure zone E, and contacting on the seal of the inner nozzle in the closed position.

* * * * *